US008269153B2

(12) United States Patent
Yang et al.

(10) Patent No.: US 8,269,153 B2
(45) Date of Patent: Sep. 18, 2012

(54) ENERGY-SAVING WATER BOILER UTILIZING HIGH-FREQUENCY INDUCTION COIL HEATING

(76) Inventors: Shun-Chi Yang, Koahsiung (TW); Mao-Hsiung Yang, Kaohsiung (TW); Tsung-Chuan Yang, Kaohsiung (TW); Fang-Ming Wu, Kaohsiung (TW); Cheng-Yen Wu, Kaohsiung (TW)

( * ) Notice: Subject to any disclaimer, the term of this patent is extended or adjusted under 35 U.S.C. 154(b) by 282 days.

(21) Appl. No.: 12/825,388

(22) Filed: Jun. 29, 2010

(65) Prior Publication Data

US 2011/0315676 A1 Dec. 29, 2011

(51) Int. Cl.
*H05B 6/10* (2006.01)
*H05B 6/44* (2006.01)

(52) U.S. Cl. ..... 219/630; 219/607; 219/628; 219/629; 219/635; 219/643

(58) Field of Classification Search ..... 219/607, 219/618, 628–630, 635, 643
See application file for complete search history.

(56) References Cited

U.S. PATENT DOCUMENTS

| | | | | |
|---|---|---|---|---|
| 6,011,245 | A * | 1/2000 | Bell | 219/631 |
| 6,553,948 | B1 * | 4/2003 | Luo | 122/18.1 |
| 7,002,119 | B2 * | 2/2006 | Wu | 219/630 |
| 2001/0027756 | A1 * | 10/2001 | Vago | 122/18.2 |
| 2003/0066829 | A1 * | 4/2003 | Kansa et al. | 219/630 |
| 2010/0213190 | A1 * | 8/2010 | Bron et al. | 219/629 |

* cited by examiner

*Primary Examiner* — Fernando L Toledo
*Assistant Examiner* — Peter Bradford
(74) *Attorney, Agent, or Firm* — Alan Kamrath; Kamrath IP Lawfirm, PA

(57) ABSTRACT

A water boiler includes a water storage tank, a heater, and a heat pipe unit. The water storage tank includes a heating room, an outer water storage room, and an inner water storage room between the heating room and the outer water storage room in a radial direction. Outside water flows from an inlet pipe to the outer water storage room, and water in the outer water storage room flows into the inner water storage room and the heating room for storage. The heater includes an induction coil. The heat pipe unit includes a plurality of heat-transfer pipes. An upper segment of each heat-transfer pipe is arranged in the heating room, while a lower segment of each heat-transfer pipe is received in the induction coil. When the induction coil turns ON, the heat-transfer pipes are heated to heat the water in the heating room.

5 Claims, 6 Drawing Sheets

ENERGY-SAVING WATER BOILER UTILIZING HIGH-FREQUENCY INDUCTION COIL HEATING

BACKGROUND OF THE INVENTION

1. Field of the Invention

The present invention relates to a water boiler and, more particularly, to a water boiler by high-frequency heating.

2. Description of the Related Art

A water boiler operated on gas, natural gas or diesel is often used in a school, hospital, hotel, office, factory, military camp or the like to provide water for drinking or washing. However, there is always a risk of incomplete combustion that leads to the production of lethal carbon monoxide. Instead, an electric water boiler can be used. There are problems, such as a low heating rate and a high thermal loss, that cause a problem to the environment.

Thus, a fast heating, energy saving, quite safe boiler is required.

BRIEF SUMMARY OF THE INVENTION

Therefore, it is an objective of the present invention to overcome the aforementioned shortcoming and deficiency of the prior art by providing a water boiler that heats heat-transfer pipes by high-frequency and heats cool water through the heat-transfer pipes so that the heating efficiency of water may increase and so that the energy consumed may decrease significantly.

To achieve the foregoing objective, a water boiler of the present invention includes a water storage tank, a heater, and a heat pipe unit. The water storage tank includes a heating room, an outer water storage room, and an inner water storage room located between the heating room and the outer water storage room in a radial direction. The heating room is in the center of the water storage tank, and the inner and outer water storage rooms are outside of the heating room in the radial direction. The outer water storage room is adapted for containing water received from a water inlet pipe. The inner water storage room is in communication with the outer water storage room and the heating room such that the water in the outer water storage room can flow into the inner water storage room and the heating room for storage. The heater includes an induction coil located outside of the water storage tank. The heat-transfer pipe unit includes at least one heat-transfer pipe. The heat-transfer pipe includes upper and lower segments spaced in a vertical direction perpendicular to the radial direction. The upper segment of the heat-transfer pipe is located in the heating room of the water storage tank, and the lower segment of the heat-transfer pipe is located outside of the heating room and in the induction coil of the heater. The heat-transfer pipe is heated to heat the water in the heating room when the induction coil turns ON.

In a preferred form, the water storage tank includes a top plate, a bottom plate, and a side plate formed between the top plate and the bottom plate and defining a periphery of the water storage tank. The water storage tank further includes first and second partition boards partitioning an interior of the water storage tank into the heating room, the inner water storage room, and the outer water storage room. The first partition board separates the inner water storage room from the outer water storage room, and the second partition board separates the inner water storage room from the heating room.

In a preferred form, the heat pipe unit includes a plurality of heat-transfer pipes. Each of the heat-transfer pipes is filled with heat conduction liquid. The upper segment of each of the heat-transfer pipes is provided with a plurality of heat transmission fins. The induction coil includes a plurality of spiral coil segments. The lower segment of each of the heat-transfer pipes is located in one of the spiral coil segments of the induction coil.

In a preferred form, the water boiler further includes a first communicating pipe in the heating room and a second communicating pipe in the inner water storage room so that the inner water storage room communicates the outer water storage room with the heating room. Each of the first and second communicating pipes includes upper and lower ends spaced in the vertical direction. The first partition board is provided with a first communicating port near the top plate of the water storage tank. The upper end of the second communicating pipe is engaged with the first communication port, and the lower end of the second communicating pipe is adjacent to the bottom plate of the water storage tank. The second partition board is provided with a second communicating port near the top plate of the water storage tank. The upper end of the first communicating pipe is engaged with the second communication port, and the lower end of the first communicating pipe is adjacent to the bottom plate of the water storage tank.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
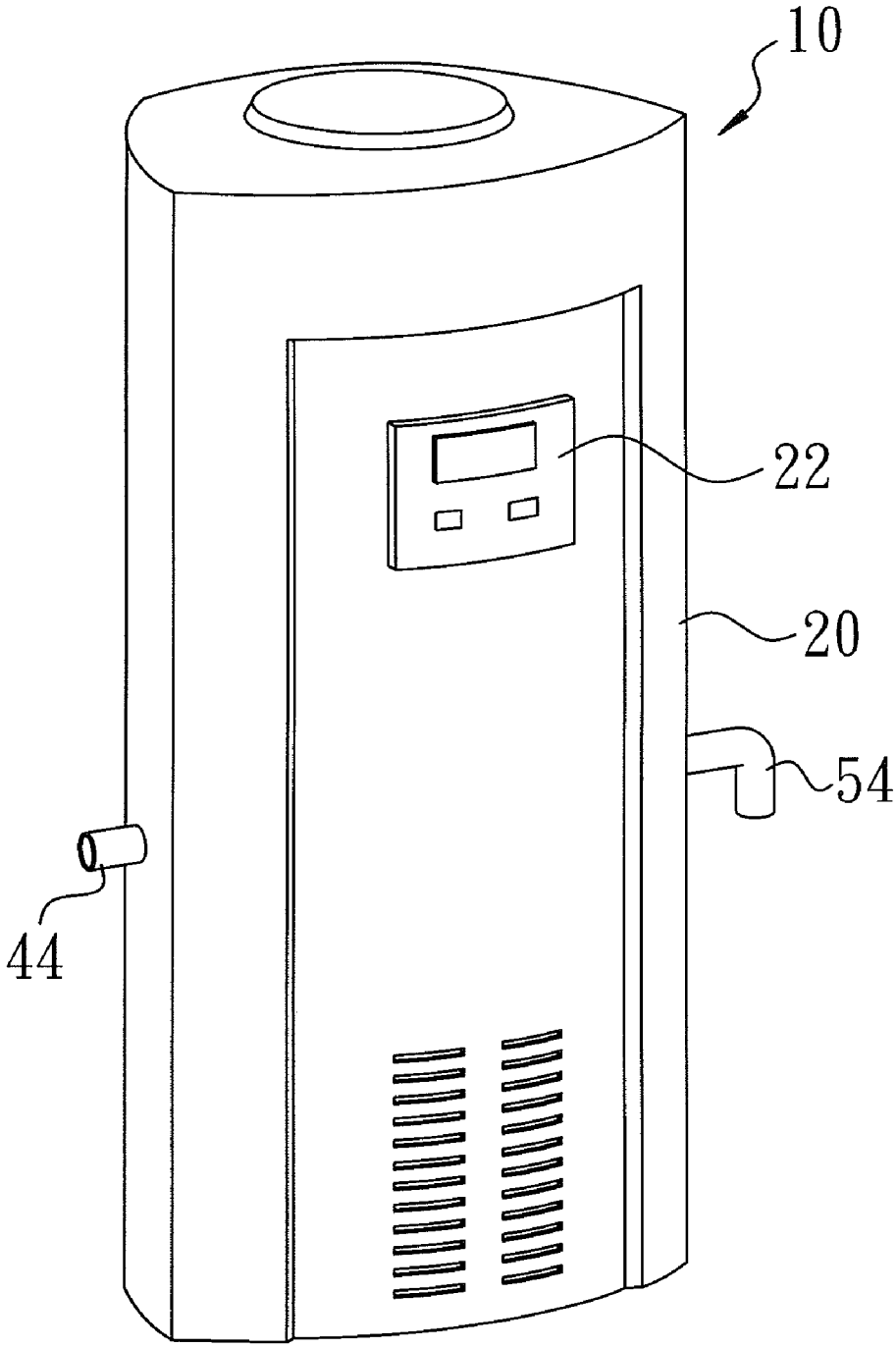
FIG. 1 is a perspective view of a water boiler according to an embodiment of the present invention.
Figure 2:
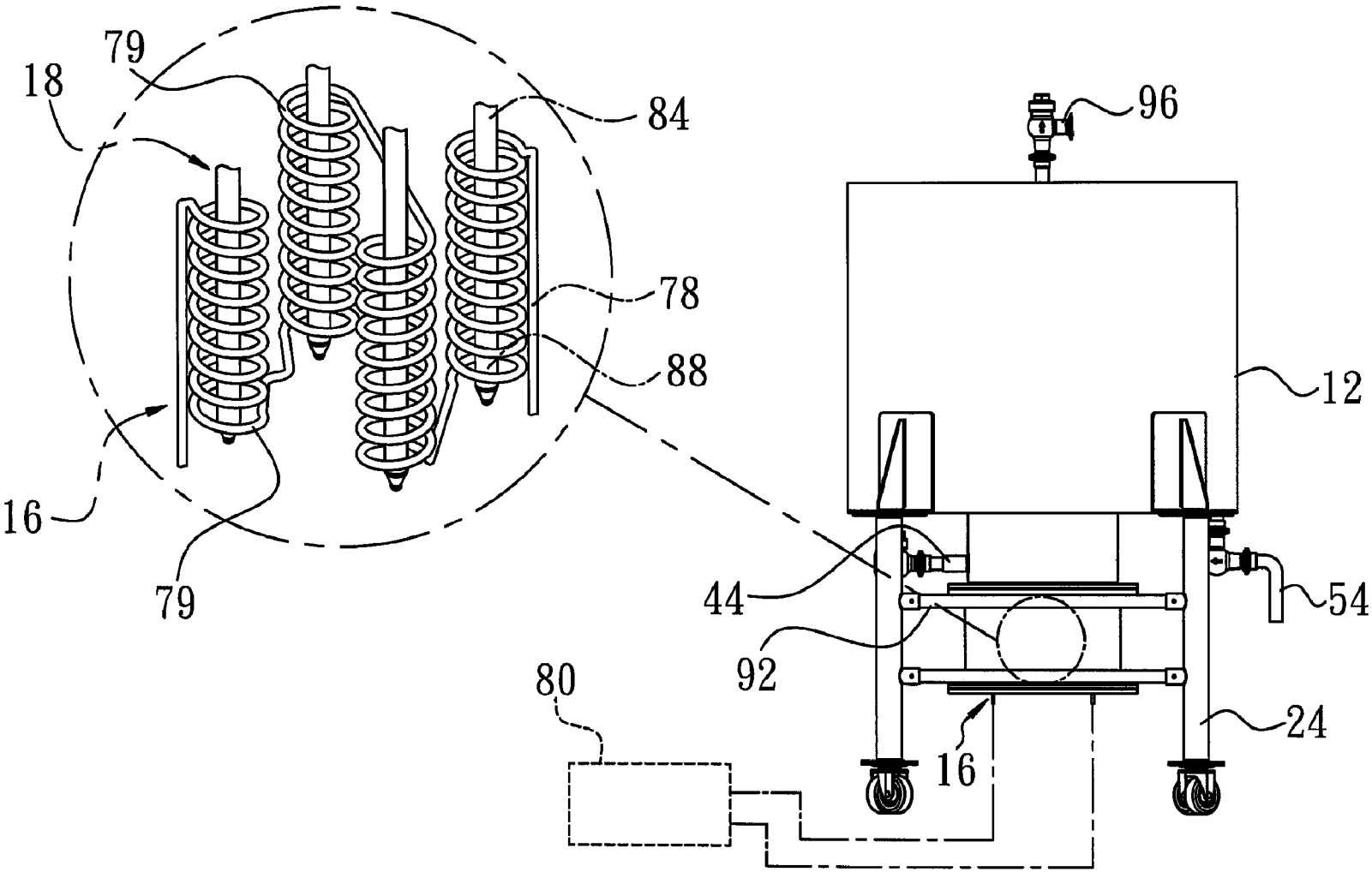
FIG. 2 is a schematic structural view of the water boiler of FIG. 1 with an outer shell of the water boiler removed.
Figure 3:
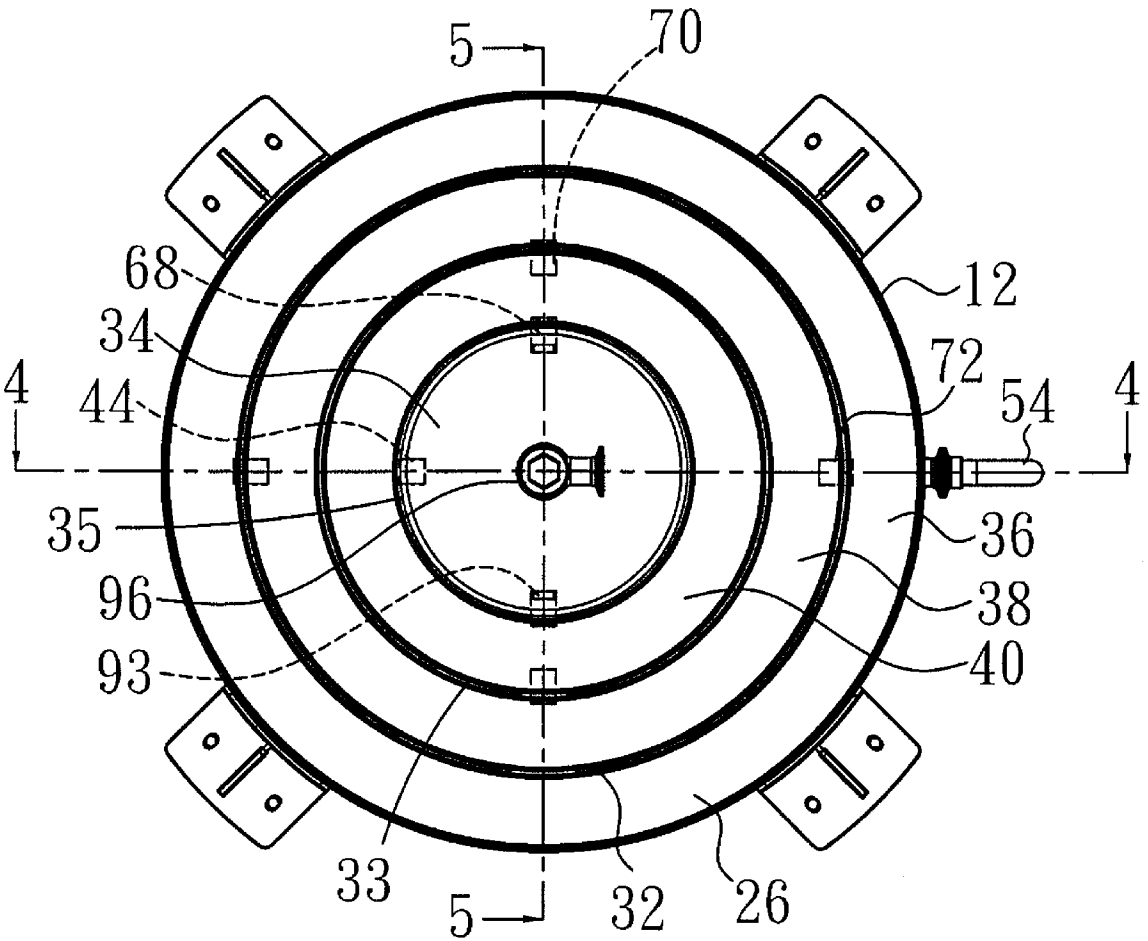
FIG. 3 is a top view of the water boiler of FIG. 2.

An energy-saving water boiler of an embodiment of the present invention is shown in FIGS. 1 through 6 of the drawings and generally designated 10. The water boiler 10 includes a water storage tank 12, a communicating pipe unit 14, a heater 16, and a heat pipe unit 18. The water storage tank 12 is provided with an outer shell 20. On the outer shell 20, a man-machine interface (operation panel) 22 is provided for users to do settings and/or read the temperature of hot water. A support frame 24 is provided below the water storage tank 12 to support the water storage tank 12.

The water storage tank 12 includes a top plate 26, a bottom plate 28, and a side plate 30 formed between the top plate 26 and the bottom plate 28 and defining a periphery of the water storage tank 12. The water storage tank 12 further includes a plurality of round partition boards therein to partition the water storage tank 12 into a heating room 34, an outer water storage room 36, and at least one inner water storage room between the heating room 34 and the outer water storage room 36 in a radial direction. In the preferred form shown, an interior of the water storage tank 12 is partitioned by first, second, and third partition boards 32, 33 and 35 and includes a first inner water storage room 38 inside of the outer water storage room 36, and a second inner water storage room 40 between the first inner water storage room 38 and the heating room 34. The first partition board 32 separates the first inner water storage room 38 from the outer water storage room 36, the second partition board 33 partitions the second inner water storage room 40 from the first inner water storage room 38, and the third partition board 35 partitions the second inner water storage room 40 from the heating room 34. The second inner water storage room 40 is located outside the heating room 34 in the radial direction. The heating room 34 is located at the center of the water storage tank 12 and is in the form of a cylinder. An opening 42 is formed at a bottom of heating room 34 so that a portion of heat pipe unit 18 can be installed in the heating room 34 through the opening 42. When the heat pipe unit 18 is mounted in the heating room 34, the opening 42 is sealed so that water can be stored in the heating room 34. An outlet pipe 44 is provided in the heating room 34 so that the water in the heating room 34 may be outputted from the outlet pipe 44. The outlet pipe 44 includes an upper end 46 in the heating room 34 and adjacent to the top plate 26 of water storage tank 12, and a lower end 48 extending out of the heating room 34 and connecting to a check valve 50.

The outer water storage room 36 in the form of a ring is located at an inner side of the side plate 30 of the water storage tank 12. A water inlet port 52 is provided in the bottom plate 28 of the outer water storage room 36 and connects to a water inlet pipe 54. One end of the water inlet pipe 54 connects to a water storage device such as a water tower (not shown) so that cool water 56 to be heated can be supplied to the outer water storage room 36. A baffle board 60 is mounted in the outer water storage room 36 such that the water 56 flowing into the outer water storage room 36 can be stopped by the baffle board 60 to reduce inflow velocity of the water. Further, a check valve 58 is provided on the water inlet pipe 54 so that water 56 in the outer water storage room 36 does not flow backwards.

Figure 4:
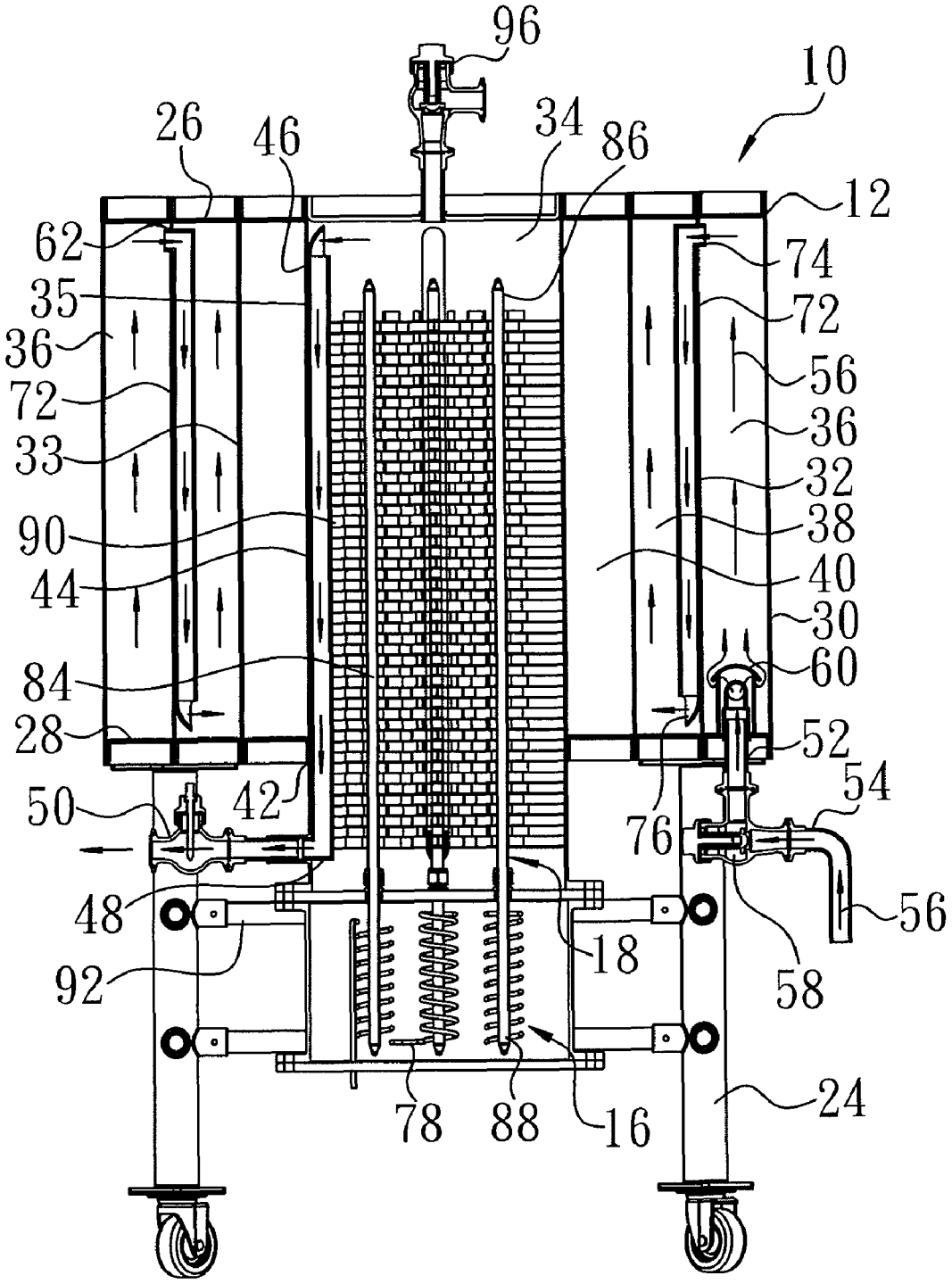
FIG. 4 is a cross-sectional view of the water boiler taken along section line 4-4 of FIG. 3.
Figure 5:
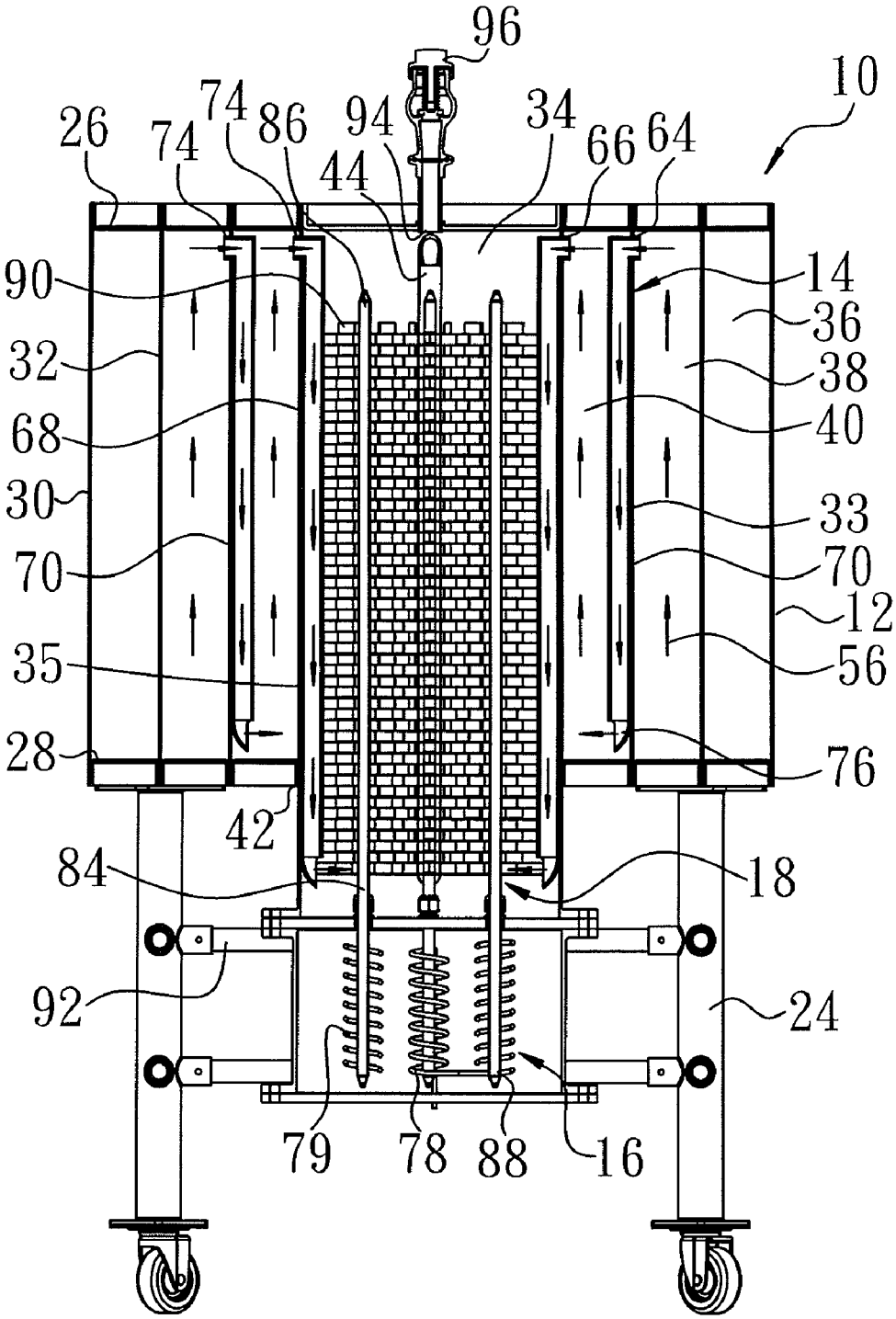
FIG. 5 is a cross-sectional view of the water boiler taken along section line 5-5 of FIG. 3.

First partition board 32 includes two first communication ports 62 opposite to each other in a circumferential direction of the first partition board 32 and near the top plate 26 (see FIG. 4). First communication ports 62 communicate the first inner water storage room 38 with the outer water storage room 36, allowing water 56 in the outer water storage room 36 to flow into the first inner water storage room 38 when the level of water 56 in the outer water storage room 36 reaches the height of the first communication ports 62. Second partition board 33 includes two second communication ports 64 opposite to each other in a circumferential direction of the second partition board 33 and near the top plate 26 (see FIG. 5). Second communication ports 64 communicate the first inner water storage room 38 with the second inner water storage room 40 so that the water 56 in the first inner water storage room 38 flows into the second inner water storage room 40 when the level of water 56 in the first inner water storage room 38 reaches the height of the second communication ports 64. Third partition board 35 includes two third communication ports 66 opposite to each other in a circumferential direction of the third partition board 35 and near the top plate 26 (FIG. 5). Third communication ports 66 communicate the heating room 34 with the second inner water storage room 40 so that the water 56 in the second inner water storage room 40 flows into the heating room 34 when the level of water 56 in the second inner water storage room 40 reaches the height of the third communication ports 66.

The communicating pipe unit 14 includes two first communicating pipes 68 in the heating room 34, two second communicating pipes 70 in the second inner water storage room 40, and two third communicating pipes 72 in the first inner water storage room 38. Each communicating pipe includes upper and lower ends 74 and 76 spaced in a vertical direction. The upper end 74 of each first communicating pipe 68 connects to one of the third communication ports 66, and the lower end 76 of each first communicating pipe 68 is adjacent to the bottom plate 28 of the water storage tank 12 so that the water 56 flowing from the second inner water storage room 40 into the heating room 34 is through a lower portion of the heating room 34. The upper end 74 of each second communicating pipe 70 connects to one of the second communication ports 64, and the lower end 76 of each second communicating pipe 70 is adjacent to the bottom plate 28 so that water 56 flowing from the first inner water storage room 38 into the second inner water storage room 40 is through a lower portion of the second inner water storage room 40. The upper end 74 of each third communicating pipe 72 connects to one of the first communication ports 62, and the lower end 76 of each third communicating pipe 72 is adjacent to the bottom plate 28 so that the water 56 flowing from the outer water storage room 36 into the first inner water storage room 38 is through the lower portion of the first inner water storage room 38.

Figure 6:
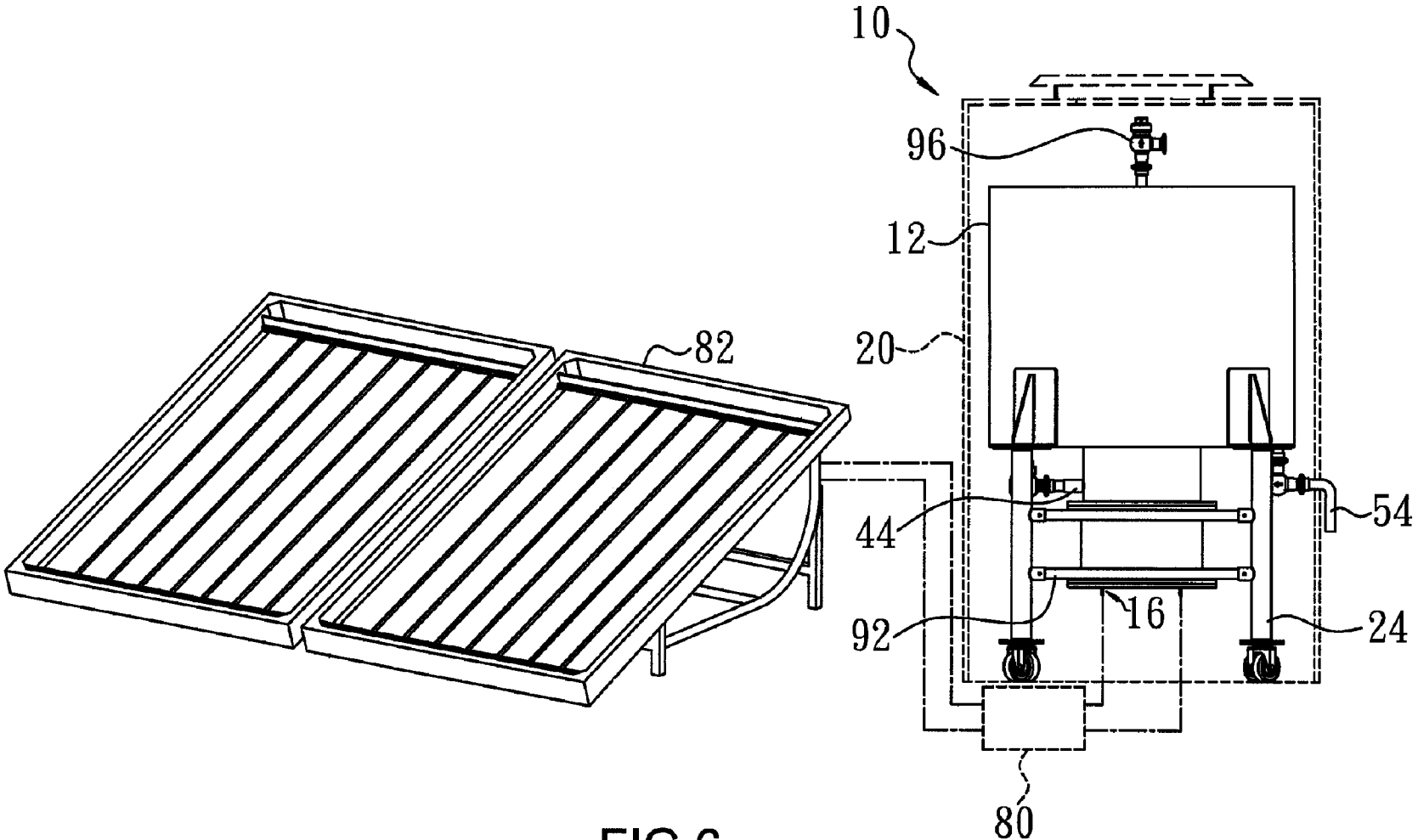
FIG. 6 shows a schematic structural view similar to FIG. 2, with the water boiler of FIG. 1 powered by a solar power generator.

In the preferred form shown, the heater 16 is operated on high-frequency and includes an induction coil 78 provided outside of the water storage tank 12. The induction coil 78 includes a plurality of spiral coil segments 79. The induction coil 78 is electrically connected to a set of high-frequency equipment 80 to supply high-frequency current to the induction coil 78. The power of the set of high-frequency equipment 80 may be AC power or a solar power generation system 82 with a tracking mechanism, as shown in FIG. 6.

The heat pipe unit 18 includes a plurality of heat-transfer pipes 84. Each heat-transfer pipe 84 is a metallic pipe filled with heat conduction liquid and includes upper and lower segments 86 and 88 spaced in the vertical direction. The heat pipe unit 18 further includes a supporting base 92 mounted on the support frame 24 for positioning the heat-transfer pipes 84. The upper segment 86 of each heat-transfer pipe 84 is arranged in the heating room 34 of water storage tank 12, and a plurality of heat transmission fins 90 are provided around the upper segment 86 of each heat-transfer pipe 84. The lower segment 88 of each heat-transfer pipe 84 is outside of the heating room 34 of the water storage tank 12 and received or located in one of the coil segments 79 of the induction coil 78 so that eddy current caused by the induction coil 78 may momentarily heat the heat-transfer pipes 84. A groove 93 is formed in each first communicating pipe 68 so that the modular heat pipe unit 18 may be installed in the heating room 34 by means of the grooves 93 as a guide for alignment.

In operation of the water boiler 10, cool water 56 is firstly sent into the outer water storage room 36 through the water inlet pipe 54 and then flows through the third communicating pipe 72, the second communicating pipe 70, and the first communicating pipe 68 sequentially to the first inner water storage room 38, the second inner water storage room 40, and the heating room 34. When the heater 16 operates, the induction coil 78 induces eddy current to momentarily heat the heat-transfer pipes 84 (to 800 degrees). When the heat-transfer pipes 84 are heated, the temperature of the heat-transfer pipes 84 heats the water 56 in the heating room 34 through the heat transmission fins 90 so that the water 56 in the heating room 34 becomes hot water. In the embodiment, a temperature detector (not shown) is provided on the outlet pipe 44 to detect the temperature of the hot water 56 outputted from the outlet pipe 44. The temperature detector is electrically connected to a control device (not shown) to control the high-frequency heater 16 so that the hot water 56 outputted from the outlet pipe 44 may reach a determined temperature. Further, the top plate 26 of the water storage tank 12 is provided with an exhaust port 94. Alternatively, the exhaust port 94 may be provided at the inlet pipe 54. A pressure relief valve 96 is provided above the heating room 34 so that the extremely high pressure of vapor may be relieved outward.

The heater 16 of the water boiler 10 according to this invention heats the heat-transfer pipes 84 of the heat pipe unit 18 by a small current rapidly to a high temperature ranging between 200 and 1000 degrees. Through the fins 90 with a large heat transmission surface, the high temperature of the heat-transfer pipes 84 is rapidly transmitted to the water 56 in the heating room 34 for heating. It is featured with lower power consumption, no danger of gas, power saving, carbon emission reduction, and safety. Further, the temperature of water in the heating room 34 may be sequentially transmitted to the water 56 in the first and second inner water storage rooms 38 and 40 and the outer water storage room 36 for pre-heating so that when water 56 is supplemented from the inner water storage rooms 38 and 40 to the heating room 34, the variation of the temperature of the water 56 in the heating room 34 is small and may be stable. The hot water 56 outputted from the outlet pipe 44 may be controlled for a precise temperature. In the structure of the water boiler 10, a pipe of small or large diameter may be used to reduce the length of piping and lower the volume, which advantageously save materials and does not occupy space.

It is appreciated that the heater 16 can be operated on microwave instead of the high-frequency. It is apparent that there may be one or more than two inner water storage rooms formed between the heating room 34 and the outer water storage room 36. There may be one or more than two first communication ports 62, second communication ports 64, and third communication ports 66. The heat pipe unit 18 may include one or two heat-transfer pipes 84. The control device may be provided with a circuit preventing air burning and with an automatic power dump switch for safety of operation. The heat-transfer pipe 84 may also be provided in the inner water storage rooms 38 and 40.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A water boiler comprising, in combination:

a water storage tank including a heating room, an outer water storage room, and an inner water storage room located between the heating room and the outer water storage room in a radial direction, with the inner and outer water storage rooms being outside of the heating room in the radial direction, with the outer water storage room being adapted for containing water received from a water inlet pipe, with the inner water storage room communicating with the outer water storage room and the heating room, wherein the water in the outer water storage room flows into the inner water storage room and the heating room for storage;

a heater including an induction coil located outside of the water storage tank; and a heat pipe unit including at least one heat-transfer pipe, with the heat-transfer pipe including an upper segment and a lower segment spaced from the upper segment in a vertical direction perpendicular to the radial direction, with the upper segment of the heat-transfer pipe located in the heating room of the water storage tank, with the lower segment of the heat-transfer pipe located outside of the heating room and in the induction coil of the heater, with the at least one heat-transfer pipe being heated to heat the water in the heating room when the induction coil turns ON.

2. The water boiler according to claim 1, with the water storage tank including a top plate, a bottom plate, and a side plate formed between the top plate and the bottom plate and defining a periphery of the water storage tank, with the water storage tank further including first and second partition boards partitioning an interior of the water storage tank into the heating room, the inner water storage room, and the outer water storage room, with the first partition board separating the inner water storage room from the outer water storage room, and with the second partition board separating the inner water storage room from the heating room.

3. The water boiler according to claim 2, with the heat pipe unit including a plurality of heat-transfer pipes, with each of the plurality of heat-transfer pipes filled with heat conduction liquid, with the upper segment of each of the plurality of heat-transfer pipes provided with a plurality of heat transmission fins, with the induction coil including a plurality of coil segments, and with the lower segment of each of the plurality of heat-transfer pipes located in one of the plurality of coil segments of the induction coil.

4. The water boiler according to claim 3, further comprising, in combination: a first communicating pipe in the heating room and a second communicating pipe in the inner water storage room, with each of the first and second communicating pipes including an upper end and a lower end spaced from the upper end in the vertical direction, with the first partition board provided with a first communicating port near the top plate of the water storage tank, with the upper end of the second communicating pipe engaged with the first communication port, with the lower end of the second communicating pipe being adjacent to the bottom plate of the water storage tank, with the second partition board provided with a second communicating port near the top plate of the water storage tank, with the upper end of the first communicating pipe engaged with the second communication port, and with the lower end of the first communicating pipe adjacent to the bottom plate of the water storage tank.

5. The water boiler according to claim 4, with the heating room including an opening at a bottom of the heating room, with the upper segment of each of the plurality of heat-transfer pipes of the heat pipe unit installed in the heating room through the opening, with the heating room in the center of the water storage tank and in the form of a cylinder, and with the water in the heating room outputted from an outlet pipe in the heating room.

* * * * *